US010974791B2

(12) United States Patent
Basu et al.

(10) Patent No.: US 10,974,791 B2
(45) Date of Patent: Apr. 13, 2021

(54) MOORING LINE AND RISER STRESS AND MOTION MONITORING USING PLATFORM-MOUNTED MOTION SENSORS

(71) Applicant: KELLOGG BROWN & ROOT LLC, Houston, TX (US)

(72) Inventors: Shiladitya Basu, Houston, TX (US); Richard D'Souza, Houston, TX (US)

(73) Assignee: KELLOGG BROWN & ROOT , LLC, Houston, TX (US)

( * ) Notice: Subject to any disclaimer, the term of this patent is extended or adjusted under 35 U.S.C. 154(b) by 96 days.

(21) Appl. No.: 16/375,068

(22) Filed: Apr. 4, 2019

(65) Prior Publication Data

US 2020/0317299 A1 Oct. 8, 2020

Related U.S. Application Data

(60) Provisional application No. 62/652,433, filed on Apr. 4, 2018.

(51) Int. Cl.
*B63B 21/20* (2006.01)
*B63B 21/50* (2006.01)
(Continued)

(52) U.S. Cl.
CPC ..... *B63B 21/20* (2013.01); *B63B 21/04* (2013.01); *B63B 21/50* (2013.01);
(Continued)

(58) Field of Classification Search
CPC ..... B63B 21/20; B63B 21/04; B63B 21/50; B63B 2021/009; B63B 2021/203; B63B 2021/505
See application file for complete search history.

(56) References Cited

U.S. PATENT DOCUMENTS 7,328,741 B2 2/2008 Allen et al.
2012/0004882 A1 1/2012 Sheynblat
(Continued)

FOREIGN PATENT DOCUMENTS

KR 10-2017-0065940 A 6/2017

OTHER PUBLICATIONS

OTC-27205-MS "Comparison of Riser Fatigue Methodologies Based on Measured Motion Data".
(Continued)

*Primary Examiner* — S. Joseph Morano
*Assistant Examiner* — Jovon E Hayes
(74) *Attorney, Agent, or Firm* — Gary M. Machetta

(57) ABSTRACT

A technique for calculating the motion and stress at any location along a riser or mooring line that is connected to an oil platform using data from multiple motion sensors that are installed above the water level on the platform is disclosed. A relationship between motion at the locations of the motion sensors and motion at the point at which the riser or mooring line is attached to the platform is determined from a model of the platform. From this relationship, the motion at the location at which the riser or mooring line is attached to the platform is computed from motion that is measured by the motion sensors. The motion and stress at any location along the riser or the mooring line is calculated based on the acceleration at the location at which the riser or mooring line is attached to the platform.

24 Claims, 5 Drawing Sheets

(51) Int. Cl.
*B63B 21/04* (2006.01)
*B63B 21/00* (2006.01)

(52) U.S. Cl.
CPC ... *B63B 2021/009* (2013.01); *B63B 2021/203* (2013.01); *B63B 2021/505* (2013.01)

(56) References Cited

U.S. PATENT DOCUMENTS

| | | | | |
|---|---|---|---|---|
| 2013/0092387 | A1 | 4/2013 | Radi | |
| 2015/0142315 | A1* | 5/2015 | Guzzo | E21B 47/001 702/6 |
| 2015/0346064 | A1* | 12/2015 | Liu | G01M 99/005 702/188 |
| 2017/0015391 | A1* | 1/2017 | Vu | B63B 35/4413 |
| 2020/0208607 | A1* | 7/2020 | Felker | B63B 35/4406 |

OTHER PUBLICATIONS

OMAE2014-23987 "A New Riser Fatigue Monitoring Methodology Based on Measured Accelerations".
International Search Report and Written Opinion for International Application No. PCT/US20/23623 filed Mar. 19, 2020 dated Jun. 4, 2020; 12 pages.

* cited by examiner

MOORING LINE AND RISER STRESS AND MOTION MONITORING USING PLATFORM-MOUNTED MOTION SENSORS

CROSS REFERENCE TO RELATED APPLICATION

This application claims priority to U.S. Provisional Patent Application having Ser. No. 62/652,433 filed on Apr. 4, 2018 which is incorporated by reference herein.

FIELD OF THE INVENTION

The present application relates to systems and techniques for determining motion and stress in mooring lines or risers that are connected to a floating platform. More specifically, the application relates to systems and techniques for determining motion and stress in mooring lines or risers based on motion data that is acquired from multiple motion sensors that are installed above a water level on the floating platform.

BACKGROUND

In the past several decades, improvements in technology have enabled hydrocarbon resources to be extracted from offshore wells in ever-increasing water depths. Modern offshore oil platforms produce hydrocarbons from reservoirs located 25,000 to 30,000 feet or more beneath the water's surface and in water depths of 10,000 feet or more. Such platforms can accommodate large daily production rates of 150,000 to 200,000 or more barrels of oil and 40 million to 50 million or more cubic feet of natural gas. Offshore oil production accounts for approximately 30% of total global oil production and it is believed that this percentage will increase in coming years with continually improving deep-water drilling and production technologies.

FIG. 1 shows a simplified diagram of a floating oil production platform 100. The illustrated platform 100 is a semi-submersible floating production platform. The platform 100 includes large ballasted pontoons 102 below the water surface. The pontoons 102 are connected to the topsides portion 104 of the platform 100 by structural columns 106. The platform's equipment (not shown) is typically positioned across multiple decks in the topsides portion 104 of the platform 100. Such equipment can include mechanical equipment for drilling and other mechanical operations (e.g., a derrick and one or more cranes), one or more manifolds to receive produced fluids that are routed to the platform 100 via one or more risers 108 (FIG. 2) that extend between the platform and subsea wells, produced fluid separation equipment, produced fluid treatment equipment, produced fluid storage equipment, produced fluid transport equipment (e.g., pumps and compressors), platform utilities and controls (plumbing and electrical equipment, bilge and ballast controls, etc.), crew accommodations (e.g., lodging and dining accommodations and transportation accommodations such as a helicopter pad), and other platform operational equipment. The platform 100 is held in place by multiple mooring lines 110 (typically 6-12) each of which attaches to the platform (typically to the support columns 106) and to an anchor that is set in the sea floor often multiple miles from the platform 100. Mooring lines 110 are typically chain, but they can also be wire rope, synthetic fiber rope, or combinations of these materials.

While a semi-submersible platform is illustrated, there are several other types of floating oil platforms such as tension leg platforms; spar platforms; and monohull structures typically called floating production, storage, and offloading (FPSO) facilities. These types of floating platforms have slightly different structures, but they all perform the same general functions. These different types of floating platforms are necessary in deeper water where it is impractical to fix the platform to the sea floor with a rigid structure.

Oil platforms are complex structures that are typically designed with a relatively long service life (e.g., 30 or more years). Over its long life, the platform 100 is exposed to a number of external environmental excitations such as wind, waves, and currents. These excitations impart a motion in the platform, which, in turn, transfers that motion to connected structures such as risers 108 and mooring lines 110. Because these connected structures are fixed at each end, the imparted motions create stress, which can ultimately lead to failure. Failure of a mooring line 110 or riser 108 can have significant consequences such as a disruption in production, damage to platform equipment, and/or loss of containment of produced fluids. It is therefore critical to predict with reasonable certainty the response of the platform 100 to external excitations (wind, wave, current, etc.) and the resulting extreme and fatigue loading of the risers 108 and the mooring lines 110.

The present standard approach for evaluating the response of a platform to external excitations is to perform predictive and model analyses. Such analyses provide a reasonable estimate of the response of a platform to typical conditions at the platform's location (e.g., typical meteorological and nautical conditions) and to anomalistic events (e.g., hurricanes) that might be expected over the platform's service life. However, these types of predictive methods are inherently limited for the following reasons. Analytic predictive models are mathematical algorithms based on linear wave kinematic theories whereas waves in extreme seas are highly non-linear and extreme response of the platform can only be roughly approximated. Predictions based on scale model tests in a wave basin are also approximations of actual responses because the Reynolds Number non-linear effects cannot be properly scaled. In both cases the predictive models rely on hindcast metocean data which in themselves are approximate predictions of actual conditions the platform will encounter over its design life.

Some platforms are designed with instrumentation such as strain gages on the mooring lines 110 and/or risers 108 to provide an actual indication of the load at the location of the instrument. However, there are several drawbacks to the use of such instrumentation as well. First, these types of instruments only evaluate the stress or strain at the particular location of the instrument. As noted above, risers 108 and mooring lines 110 are often multiple miles long and the measured load at the location of a single instrument is not necessarily representative of the load at another location along the same component. Thus, multiple instruments are typically installed at strategically-selected locations along the mooring lines 110 and/or risers 108. Second, the instruments are prone to failure as a result of the harsh conditions in which they are installed (e.g., in high pressure seawater). Moreover, their underwater location essentially guarantees that it will be cost prohibitive to replace the instrument when it does fail. Third, the instruments must be engineered as part of the component on which they are to be installed, which can undesirably increase engineering complexity and impact scheduling. Therefore, while instruments installed on the components to be monitored provide some feedback, they still fail to provide a full view of the loads to which the mooring lines 110 and risers 108 have been exposed.

There is therefore a need to monitor, anticipate, and intervene in advance of a failure of any one of the critical mooring 110 and riser 108 elements after a floating oil platform is commissioned.

DETAILED DESCRIPTION OF THE INVENTION

Figure 1:
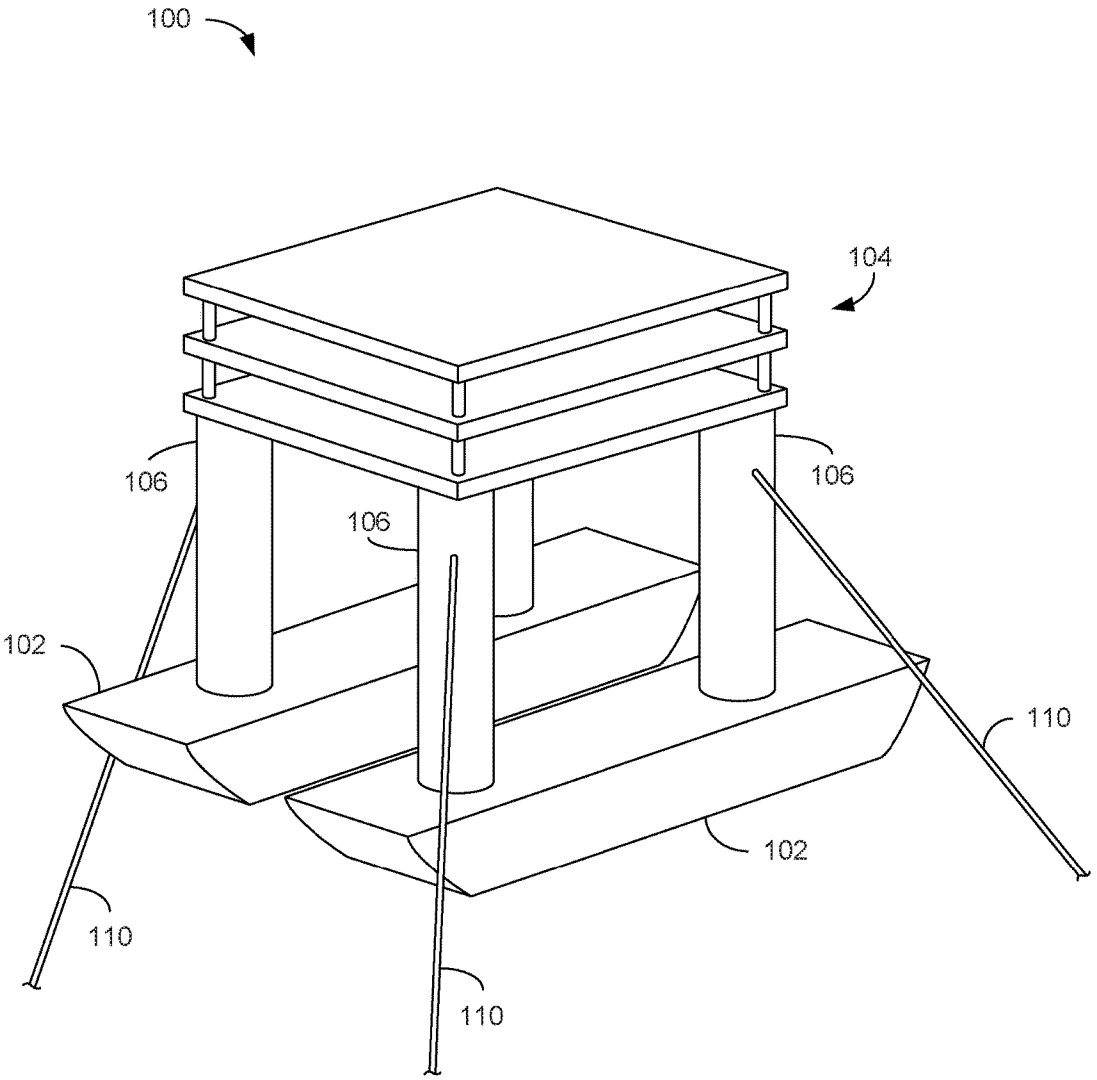
FIG. 1 is a simplified diagram of an oil production platform.
Figure 2:
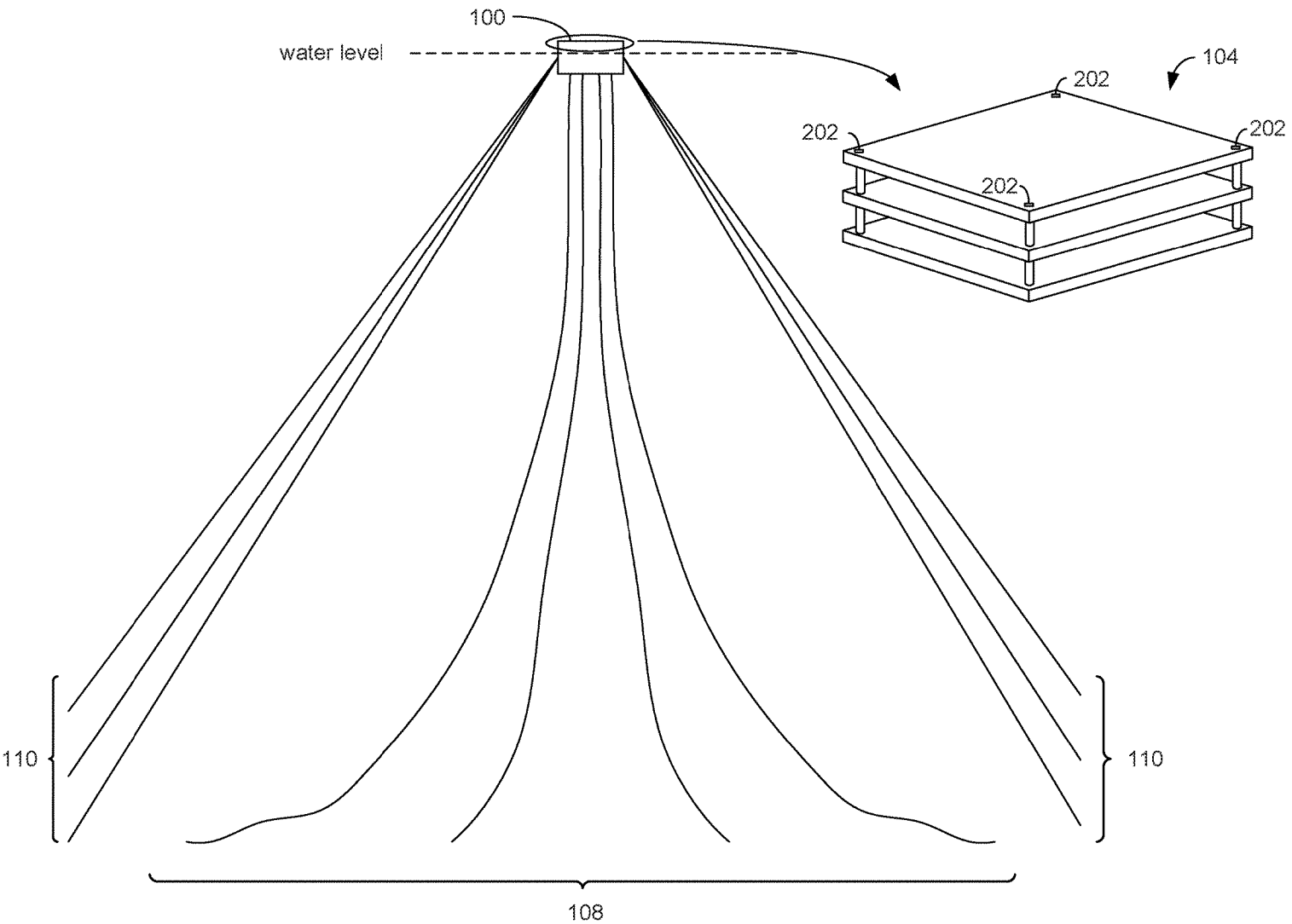
FIG. 2 is a simplified diagram of an oil production platform that includes multiple motion sensors in accordance with an aspect of the disclosure.

FIG. 2 shows a block diagram of a platform 100 that includes multiple motion sensors 202 that are installed at various locations in the topsides portion 104 of the platform 100 above the water level. While an oil production platform is described for purposes of illustration, the disclosed technique is applicable to other moored floating devices such as floating drill rigs. In one embodiment, each of the motion sensors 202 is a three-axis accelerometer. In such an embodiment, each motion sensor 202 provides three separate outputs, each output representing acceleration along one of three orthogonal axes. The one or more outputs of the motion sensors 202 may be described as motion data that provides a representation of the motion at the location at which the motion sensor 202 is installed. As will be understood, motion sensors 202 are relatively simple devices that are easily installed in the topsides 104. In contrast to instruments that are installed along the risers 108 or mooring lines 110, motion sensors 202 can be installed without any heavy equipment (e.g., cranes, winches, etc.), above the water level, and during or after commissioning of the platform 200. Moreover, should any motion sensor 202 fail during the life of the platform, it is easily replaceable.

In the illustrated embodiment, four motion sensors 202 are shown positioned near the outer perimeter of an upper deck of the platform 100, but the number and position of the motion sensors 202 is application-specific and can vary. The motion sensors 202 should, however, be spaced such that they collectively provide an indication of the overall motion of the platform 100. In one embodiment, three to nine motion sensors 202 are spaced about the platform 100.

The inventors have determined that the motion at any platform location can be determined based on the outputs of the motion sensors 202. In a preferred embodiment, acceleration outputs from the motion sensors are utilized to determine the six degrees of freedom (heave, sway, surge, yaw, roll, pitch) rigid body motions at the platform 200's center of gravity. The motion at any motion sensor 202 is a function of the motion at the platform 100's center of gravity and the sensor 202's location. Thus, for the set of motion sensors:

$$m_1 = f_1(m_{CG}, pos_1)$$
$$m_2 = f_2(m_{CG}, pos_2)$$
$$\vdots$$
$$m_n = f_n(m_{CG}, pos_n)$$

where m represents motion, pos represents position, the subscripts 1 through n correspond to the n motion sensors, and the subscript CG corresponds to the platform 100's center of gravity. The functions that relate the motion at a given sensor location to the motion at the center of gravity ($f_1$ through $f_n$) can be determined, for example, through a simple transformation matrix. Given the complexity of floating platforms, they are modeled in detail using three-dimensional modeling software during the design of the platform. The three-dimensional model specifies in detail the size, shape, location, and materials of construction of the components of the platform 100. From this existing three-dimensional model, the functions that relate the motion at a given sensor location to the motion at the center of gravity can be determined through finite element analysis. As will be understood, the locations in which the motion sensors 202 are actually installed must be precisely specified to obtain accurate relationships.

The set of functions collectively form a transfer function. In a preferred embodiment, the transfer function is expressed in terms of a transformation matrix that relates the measured motions at each of the sensors 202 to the motion at the platform 100's center of gravity.

$$\begin{bmatrix} m_1 \\ m_2 \\ \vdots \\ m_n \end{bmatrix} = [transform_{CG}]m_{CG}$$

The motion at the platform 100's center of gravity can then be calculated for a given set of measured motion values from the inverse of the transformation matrix.

$$m_{CG} = [transform_{CG}]^{-1}\begin{bmatrix} m_1 \\ m_2 \\ \vdots \\ m_n \end{bmatrix}$$

A similar process can be utilized to determine the motion at other points of interest based on the calculated value of the motion at the center of gravity (mco). For example, in one embodiment, the motion (e.g., the six degrees of freedom motion) at each riser or mooring line hang off point (i.e., the point at which the riser or mooring line attaches to the platform 100) is computed from the calculated motion at the center of gravity according to the following analogous equations.

$$\begin{bmatrix} m_{mooring\ 1} \\ m_{mooring\ 2} \\ \vdots \\ m_{mooring\ j} \end{bmatrix} = [transform_{CG\ to\ mooring}]^{-1}m_{CG}$$

-continued $$\begin{bmatrix} m_{riser\,1} \\ m_{riser\,2} \\ \vdots \\ m_{riser\,k} \end{bmatrix} = [transform_{CG\ to\ riser}]^{-1} m_{CG}$$

where the subscripts mooring 1 to mooring j correspond to the hang off locations for the j mooring lines, the subscripts riser 1 to riser k correspond to the hang off locations for the k risers, $transform_{CG\ to\ mooring}$ is a transformation matrix that relates the motion at the platform 100's center of gravity to the motion at each of the j mooring line hang off locations, and $transform_{CG\ to\ riser}$ is a transformation matrix that relates the motion at the platform 100's center of gravity to the motion at each of the k riser hang off locations. Just as with the relationship between motion at the sensor 202 locations and motion at the platform 100's center of gravity, the relationship between motion at the mooring and riser hang off locations and motion at the platform's center of gravity can be determined through finite element analysis. It will be understood that motion can be expressed in different ways (e.g., displacement from baseline, rate of displacement, acceleration, angular rate, etc.) and thus the term motion as used herein encompasses the different ways of expression. Just as the motion sensors 202 may measure acceleration in three orthogonal axes, the motion at a particular point of interest (e.g., platform center of gravity, mooring line or riser hang off etc.) might be expressed at least partially as acceleration in three orthogonal axes and the transformation functions will account for the way in which motion is measured by the sensors 202 and expressed at the point of interest.

It will be understood that it is not strictly necessary to calculate the motion at the platform 100's center of gravity. Instead, the motion at any point of interest can be calculated directly from a relationship between motion at that point of interest and motion at the locations of the motion sensors 202. Nonetheless, the inventors find the determination of the motion at the platform 100's center of gravity to be a useful value from which motion at other points may be derived as well as other useful performance data and to calibrate actual to anayltic/scale model predictions. This latter calibration is useful to reconcile and improve confidence in analytic model predictions in the future.

The motion and stress at any location along any of the mooring lines 108 or risers 110 can be determined from the calculated motion at that mooring line or riser's hang off point using known dynamic analysis modeling algorithms. Such algorithms may be embodied in a public domain, licensed, non-linear, time-domain finite element software such as OrcaFlex or SESAM. The software only requires the motion at the hang off point to compute stresses or tensions at any select point along the riser or mooring line at each instant of time. The software is widely accepted and utilized by industry as to the accuracy of stress and tension predictions.

Thus, the motion and stress can be determined at any location in any mooring line 108 or riser 110 from the outputs of the motion sensors 202 that are conveniently installed above the water level on the platform 100. This technique provides much more data (i.e., motion and stress at any location) than is provided by dedicated instruments such as strain gages, which only measure strain at the discrete location at which they are installed. In addition, motion sensors 202 are much easier to install, less expensive, and can be installed much later in the design process than such dedicated instruments.

Figure 3:
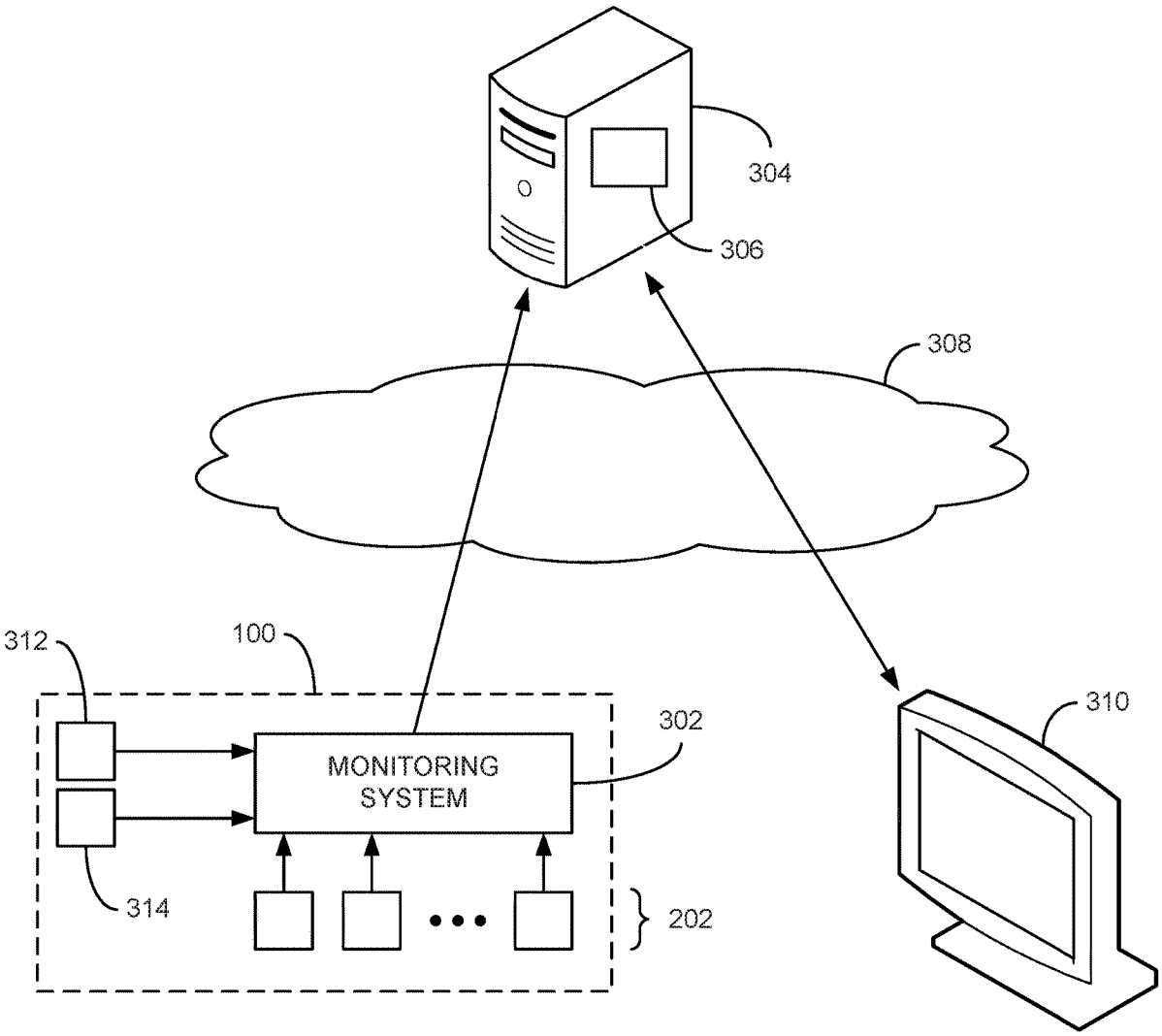
FIG. 3 is a block diagram showing components of a system for determining motion at any location of an oil production platform in accordance with an aspect of the disclosure.

Referring to FIG. 3, in one embodiment, the motion sensors 202 are connected to a monitoring system 302 that is installed locally on the platform 100 such as a distributed control system (DCS), a programmable logic controller (PLC), or a supervisory control and data acquisition (SCADA) system. In one embodiment, the monitoring system 302 may be a dedicated platform motion system. The output(s) of the motion sensors 202 may comprise a hard-wired analog signal (e.g., a 4-20 mA signal) or a digital signal (e.g., a Foundation Fieldbus signal). The motion sensors 202 may be independently powered or they may be powered by the monitoring system 302 to which they are connected. In one embodiment, the monitoring system 302 additionally receives inputs from one or more water current sensors 312 that indicate a direction and magnitude of water current and one or more wind sensors 314 that indicate a direction and magnitude of wind.

In a preferred embodiment, the inputs that are received by the monitoring system 302 from the motion sensors 202, water current sensors 312, and wind sensors 314 are time-stamped, and the time-stamped data is provided to a computing device 304 via a communications network 308. In one embodiment, the communications network 308 is a wide area network such as the Internet and the computing device 304 is located remotely from the platform (e.g., onshore). The numerical relationships that define the motions at desired points of interest (e.g., the center of gravity, riser and mooring line hang off locations, and any other points of interest) for measured motions at the motion sensor 202 locations and the numerical relationships that define the motion and stresses in the mooring lines 110 and risers 108 for a given hang off location motion are embodied in a computer program 306 that is executed by the computing device 304.

In one embodiment, the program 306 continually computes the motion and stress at each point along each mooring line 110 and riser 108 for each point in time for which motion sensor data is provided. As will be understood, computing these values for every location is computationally demanding and requires a large amount of computing power. Thus, in an alternate embodiment, the program 306 continually computes the motion and stress for only a preselected number of locations along the mooring lines 110 and risers 108 for each point in time for which motion sensor data is provided. The preselected locations may be selected as locations of particular interest such as locations at which extreme conditions might be expected. In another alternative embodiment, the program 306 continuously computes the motion and stress for only a preselected number of locations along the mooring lines 110 and risers 108 for each point in time for which motion sensor data is provided and computes the motion and stress at other non-selected locations along the mooring lines 110 and risers 108 on a coarser time scale (i.e., not for every time for which motion sensor data is provided). As will be understood, limiting the number of locations for which motion and stress are computed and increasing the coarseness of the time resolution of such calculations, decreases the computational demand. Thus, the temporal and locational resolutions of the calculations are preferably user-selectable parameters of the program 306. In any event, all motion sensor data may be retained (e.g., in a memory associated with the computing device 304) such that motion and stress can be computed for any location with any desired level of resolution at any point in time from historical data.

The program 306 may also provide a user interface through which the user can view desired data. In one embodiment, the computing device 304 includes a web server by which it provides access to the graphical user interface to a remote computer 310 operating a web browser and providing the proper access credentials.

Figure 4:
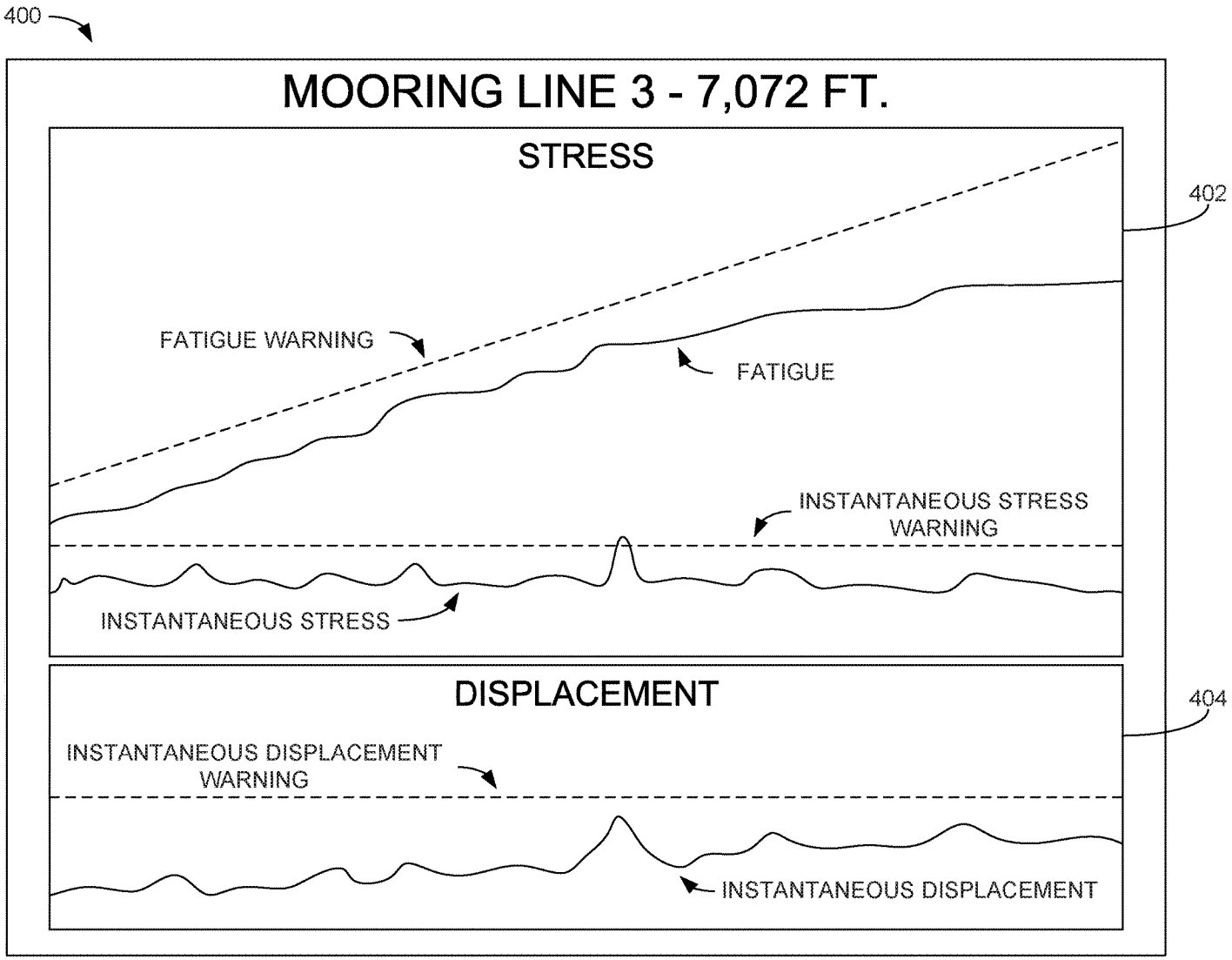
FIG. 4 is an example of a graphical user interface that displays calculated stress and displacement in a mooring line or riser in accordance with an aspect of the disclosure.

FIG. 4 illustrates an example of a graphical user interface that might be provided by the program 306. In the illustrated interface 400, stress and displacement are charted over a selected time interval for a selected location along a selected mooring line 110 (i.e., mooring line 3 at 7,072 feet from the hang off point). This interface may be accessed, for example, by selecting a desired location (e.g., the mooring line 110 or riser 108 location for which information is desired) from an interface that depicts a model of the platform 100. In the stress chart interface 402, both instantaneous stress and fatigue are plotted for the selected mooring line location over the selected time interval. Also plotted in the stress chart interface 402 are fatigue and instantaneous stress warning levels. These warning levels may be configured by a user, and an alert may be generated if the calculated fatigue or instantaneous stress exceeds the corresponding warning level. The warning levels would typically be selected at a value that is below the design conditions but that nonetheless warrants an alert. Instantaneous stress is the amount of stress that is exerted at the selected location at any particular point in time. Fatigue is the integral of instantaneous stress over time and represents the amount of stress experienced at the selected location over its lifetime. Comparison of the calculated fatigue to the fatigue warning level informs the user whether the location is performing within design conditions over its lifetime (i.e., whether the location might be expected to last for the design lifetime or might require replacement).

In the displacement chart interface 404, instantaneous displacement at the selected location is plotted along with an instantaneous displacement warning level. As with the stress values, an alert may be generated if the instantaneous displacement exceeds the instantaneous displacement warning level. While displacement is shown in the interface 400 as a single magnitude value, in an alternate embodiment displacement in each of three orthogonal dimensions may be illustrated.

In one embodiment, the program 306 continuously evaluates whether an alert should be generated for any monitored location. Generated alerts may be consolidated in a dashboard type interface that allows the user to explore the alert in more detail (e.g., to browse to the stress and displacement interface 400 associated with the alert). In addition, alerts may be communicated such as via an email that provides a link to the dashboard interface.

Figure 5:
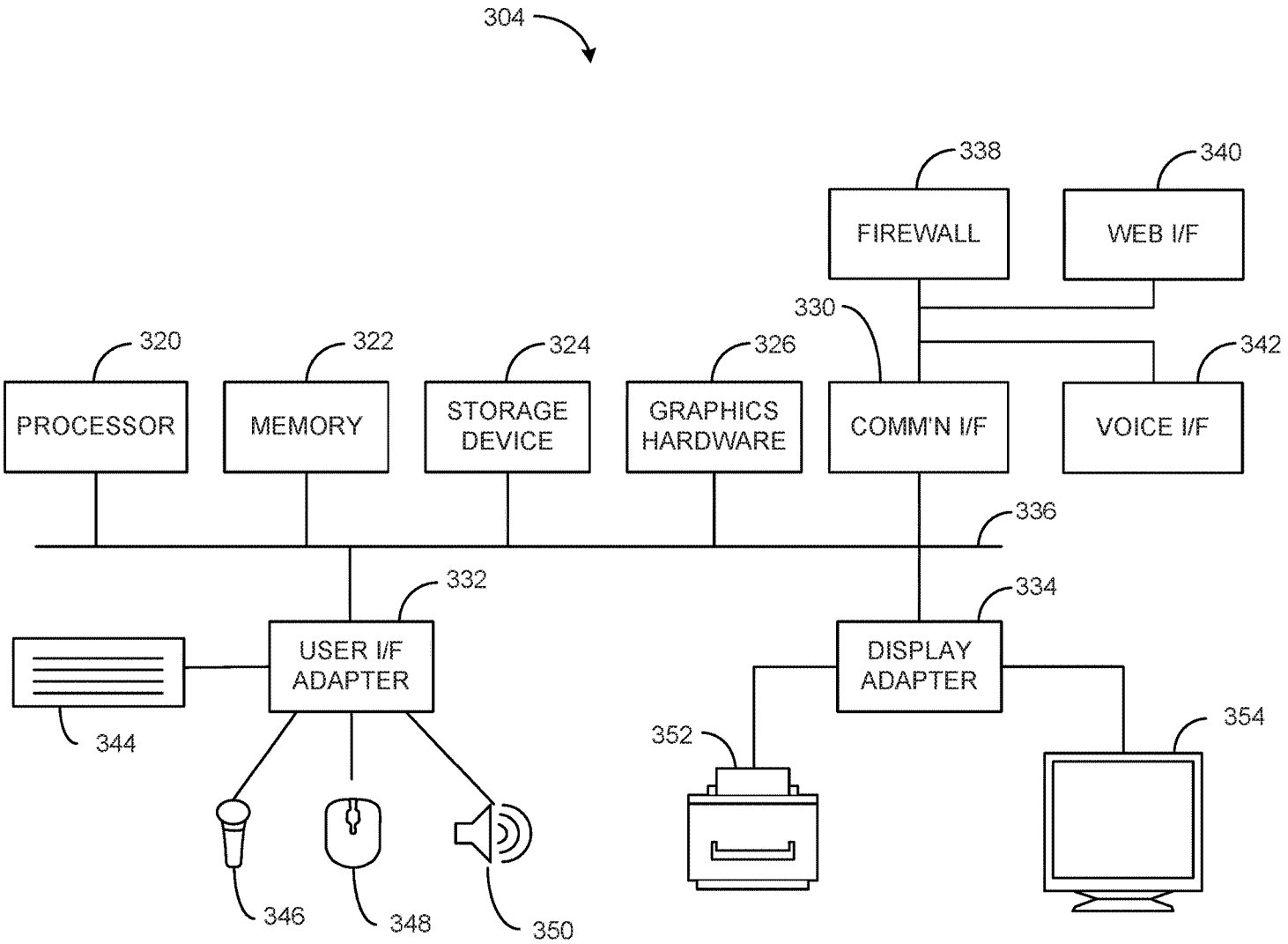
FIG. 5 illustrates a representative computing environment on which a program that calculates motion and stress at any riser or mooring line location from motion sensor data may be executed in accordance with an aspect of the disclosure.

FIG. 5 illustrates the various components of an example computing device 304 that may be configured to execute the program 306. The computing device 304 can include a processor 320, memory 322, storage 324, graphics hardware 326, communication interface 330, user interface adapter 332 and display adapter 334—all of which may be coupled via system bus or backplane 336. Memory 322 may include one or more different types of media (typically solid-state) used by the processor 320 and graphics hardware 326. For example, memory 322 may include memory cache, read-only memory (ROM), and/or random access memory (RAM). Storage 324 may store media, computer program instructions or software (e.g., program 306), preference information, device profile information, and any other suitable data. Storage 324 may include one or more non-transitory computer-readable storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), Electrically Erasable Programmable Read-Only Memory (EEPROM), and USB or thumb drive. Memory 322 and storage 324 may be used to tangibly retain computer program instructions or code organized into one or more modules and written in any desired computer programming language. As will be understood, the program 306 may be stored on a medium such as a CD or a USB drive, pre-loaded on computing device 304, or made available for download from a program repository via a network connection. Communication interface 330 may be used to connect the computing device 304 to a network such as communications network 308. Communications directed to the computing device 304 may be passed through a protective firewall 338. Such communications may be interpreted via web interface 340 or voice communications interface 342. Illustrative networks include, but are not limited to: a local network such as a USB network; a business' local area network; or a wide area network such as the Internet. User interface adapter 332 may be used to connect a keyboard 344, microphone 346, pointer device 348, speaker 350 and other user interface devices such as a touch-pad and/or a touch screen (not shown). Display adapter 334 may be used to connect display 354 and printer 352. Processor 320 may include any programmable control device. Processor 320 may also be implemented as a custom designed circuit that may be embodied in hardware devices such as application specific integrated circuits (ASICs) and field programmable gate arrays (FPGAs). The computing device 304 may have resident thereon any desired operating system. While FIG. 5 has been described in terms of the computing device 304, the computing device 310 may have similar components.

While various specific embodiments and applications have been described for purposes of illustration, numerous modifications and variations could be made by those skilled in the art without departing from the scope of the invention set forth in the claims.

What is claimed is:

1. A system, comprising:

a plurality of motion sensors configured to be installed above a water level on a floating platform;

a processor configured to receive motion data from each of the plurality of motion sensors and a non-transitory computer-readable medium and having instructions stored thereon, which when executed by the processor, cause a processor to:

receive motion data from each of the plurality of motion sensors;

calculate motion at a first location on the floating platform based on the received motion data;

calculate motion at a second one or more locations on the floating platform based on the calculated motion at the first location; and calculate at least one of motion and stress at one or more locations along a riser or a mooring line that is connected to the floating platform based on the calculated motion at the second one or more locations on the floating platform.

2. The system of claim 1, wherein each of the motion sensors comprises an accelerometer.

3. The system of claim 1, wherein the first location is a center of gravity of the floating platform.

4. The system of claim 1, wherein the second one or more locations comprise locations where the riser and/or mooring line is connected to the floating platform.

5. The system of claim 4, wherein the motion at the point where the riser or the mooring line is connected to the floating platform is calculated based on a modeled relationship between motion at locations of the motion sensors and the motion at the point where the riser or the mooring line is connected to the floating platform.

6. The system of claim 4, wherein the motion at the point where the riser or the mooring line is connected to the floating platform is based on a modeled relationship between the first location and the point where the riser or the mooring line is connected to the floating platform.

7. The system of claim 6, wherein the motion at the first point is calculated based on a modeled relationship between motion at locations of the motion sensors and the motion at the center of gravity.

8. The system of claim 1, wherein the motion sensors are connected to a monitoring device on the floating platform.

9. The system of claim 8, wherein the motion data is time-stamped motion data that is provided by the monitoring device.

10. The system of claim 1, wherein the instructions cause the processor to present a graphical user interface that displays the at least one of motion and stress at the one or more locations along the riser or the mooring line.

11. The system of claim 10, wherein the graphical user interface displays the at least one of motion and stress at the one or more locations along the riser or the mooring line at each of a plurality of times.

12. The system of claim 1, wherein the instructions cause the processor to generate an alert when the at least one of motion and stress at the one or more locations along the riser or the mooring line exceeds a corresponding warning level.

13. A method for determining a motion or stress at one or more locations along a riser or a mooring line that is connected to a floating platform, comprising:

sensing motion data from each of a plurality of motion sensors installed above a water level on the floating platform;

calculating, based on the received motion data and one or more first transformation functions, motion at a first location on the floating platform;

calculating motion at a second one or more locations on the floating platform based on the calculated motion at the first location and one or more second transform functions; and calculating a motion or stress at the one or more locations along the riser or the mooring line based on the calculated motion at the second one or more locations.

14. The method of claim 13, wherein each of the motion sensors comprises an accelerometer.

15. The method of claim 13, wherein each accelerometer provides three outputs that are each indicative of acceleration in one of three orthogonal axes.

16. The method of claim 13, wherein the second one or more locations on the floating platform comprises a location where the riser or the mooring line is connected to the floating platform.

17. The method of claim 16, wherein the second one or more transformation functions relate motion at the first location with motion at the point where the riser or the mooring line is connected to the floating platform.

18. The method of claim 16, wherein the first location comprises a center of gravity of the floating platform.

19. The method of claim 18, wherein the first one or more transformation functions relate motion at locations of the motion sensors with the motion at the center of gravity.

20. The method of claim 13, wherein the motion sensors are connected to a monitoring device on the floating platform.

21. The method of claim 20, wherein the motion data is time-stamped motion data that is provided by the monitoring device.

22. The method of claim 13, further comprising presenting a graphical user interface that displays the motion or stress at the one or more locations along the riser or the mooring line.

23. The method of claim 22, wherein the graphical user interface displays the motion or stress at the one or more locations along the riser or the mooring line at each of a plurality of times.

24. The method of claim 13, further comprising generating an alert when the motion or stress at the one or more locations along the riser or the mooring line exceeds a corresponding warning level.

* * * * *